US006450094B2

(12) United States Patent
Koppelkamm

(10) Patent No.: US 6,450,094 B2
(45) **Date of Patent: *Sep. 17, 2002**

(54) DEVICE FOR FASTENING FLEXIBLE PRINTING PLATES

(75) Inventor: Günter Koppelkamm, Neuensalz (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/771,744

(22) Filed: Jan. 29, 2001

(30) Foreign Application Priority Data

Jan. 29, 2000 (DE) ..... 100 03 937

(51) Int. Cl.[7] ..... B41F 27/06
(52) U.S. Cl. ..... 101/415.1; 101/378
(58) Field of Search ..... 101/415.1, 378, 101/409, 407.1, 383

(56) References Cited

U.S. PATENT DOCUMENTS

| | | | | |
|---|---|---|---|---|
| 2,186,764 A | * | 1/1940 | Meisel | 101/415.1 |
| 3,191,532 A | | 6/1965 | Hermach et al. | 101/415.1 |
| 6,240,845 B1 | | 6/2001 | Koppelkamm | 101/415.1 |

FOREIGN PATENT DOCUMENTS

| | | |
|---|---|---|
| DE | 1 561 082 | 4/1970 |
| DE | 198 41 912 | 3/2000 |
| GB | 1 274 180 | 5/1972 |
| GB | 2 343 143 | 5/2000 |

* cited by examiner

*Primary Examiner*—Leslie J. Evanisko
(74) *Attorney, Agent, or Firm*—Cohen, Pontani, Lieberman & Pavane

(57) ABSTRACT

A device for fastening flexible printing plates to a plate cylinder of rotary printing machines is provided. The plate cylinder has a channel, a channel gap, and a bore. The channel accommodates bent ends of the printing plate. The bore in the channel is axially parallel to the plate cylinder. Two segmented shafts are arranged pivotally in the bore and have leaf springs which are fastened to the segmented shafts. The leaf springs can be brought into contact with the ends inserted into the channel. The channel has at least one lateral recess or cut out in an area which connects the bore radially to a channel gap on the periphery of the plate cylinder, and is at a distance form the channel gap. The end of the printing plate which is bent approximately at a right angle, is provided with a shaped element projecting in the direction of recesses in the channel. The shaped element of the end inserted into the channel can be moved into the recess by bringing the leaf springs into pressure contact with the bent end.

11 Claims, 4 Drawing Sheets

DEVICE FOR FASTENING FLEXIBLE PRINTING PLATES

BACKGROUND OF THE INVENTION

1. Field of the Invention

The present invention relates to a device for fastening flexible printing plates. More specifically, the present invention relates to a device for fastening flexible printing plates by securing ends of a printing plate in a plate cylinder of a rotary printing machine having a channel, and a bore, where the ends are secured in the channel using securing means.

2. Description of the Related Art

German reference DD 261 765 A1 discloses a device for fastening flexible printing plates to a plate cylinder of rotary printing machines. The device has a channel in the plate cylinder, which accommodates the bent ends of the printing plate, a bore in the channel which is axially parallel to the plate cylinder, two segmented shafts arranged pivotally in the bore and leaf springs which are each fastened to the segmented shafts and can be brought into contact with the ends inserted into the channel. The segmented shafts are mounted in the bore in the channel via a hollow shaft which is cut out for the leaf springs. The ends of the printing plates are bent at different acute angles depending on the direction of rotation of the plate cylinder. A leading end is clamped directly by the leaf springs against an oblique channel side wall. A trailing end is clamped between the leaf springs and a clamping bar fastened to the hollow shaft. The device depends upon the direction of rotation and has a relatively wide channel opening on the periphery of the plate cylinder, because of the double mounting of the segment shafts in the bore. The device requires a correspondingly high outlay, and is not suitable for automated printing-plate changing applications.

SUMMARY OF THE INVENTION

The object of the present invention is to provide a device for fastening flexible printing plates which secure the ends of the printing plate in the channel, even during high speed of revolution of the plate cylinder, and to ensure a printing plate change which enables the printing plate to be recycled. It is a further object to provide a fastening device of simple construction that is not susceptible to faults and is suitable for automatic printing plate change operations.

To achieve this object, the device includes a printing cylinder having a channel, a channel gap, at least one lateral cut out (or recess) and a bore. The bore is at a radial terminus of the channel. A segmented shaft is pivotally arranged in the bore. Leaf springs are arranged in the channel and attached to the segmented shaft. The leaf springs may be pressed against bend ends of a flexible printing plate so as to secure the bend ends when they are inserted into the channel.

The invention secures bent ends of the printing plate against slipping out of the channel by a positive and frictional connection produced by the interaction of shaped elements, recesses, contact faces and the leaf springs. Performance is assured even at a high circumferential speed of the plate cylinder. The device according to the present invention can be used irrespective of the direction of rotation with respect to the plate cylinder, and in conjunction with the rectangularly bent ends of the printing plate. It is suitable for automatic printing plate changing, since the insertion and withdrawal of both ends always takes place at the same angle, namely at right angles to the plate cylinder, and does not require any change in the direction of rotation of the plate cylinder. In addition, the printing plate is not damaged during the changing operation, ensuring its multiple use.

The interaction during a printing plate change of shaped elements having a relatively low height, together with the recesses and/or contact faces in the channel, makes it possible to have a narrow channel gap on the periphery of the plate cylinder. This benefits the printing process by minimizing channel impacts. Finally, the direct arrangement of the segmented shafts in the bore of the channel ensures a simple construction of the device, and the indirect support of the segmented shafts via supporting elements, in conjunction with the large clearance between the segmented shaft and the bore, ensures low susceptibility to faults with regard to the mobility of the mechanisms as a result of contamination getting into the channel.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views, the present invention is described, in schematic form, as follows.

DETAILED DESCRIPTION OF THE PRESENTLY PREFERRED EMBODIMENTS

Figure 1:
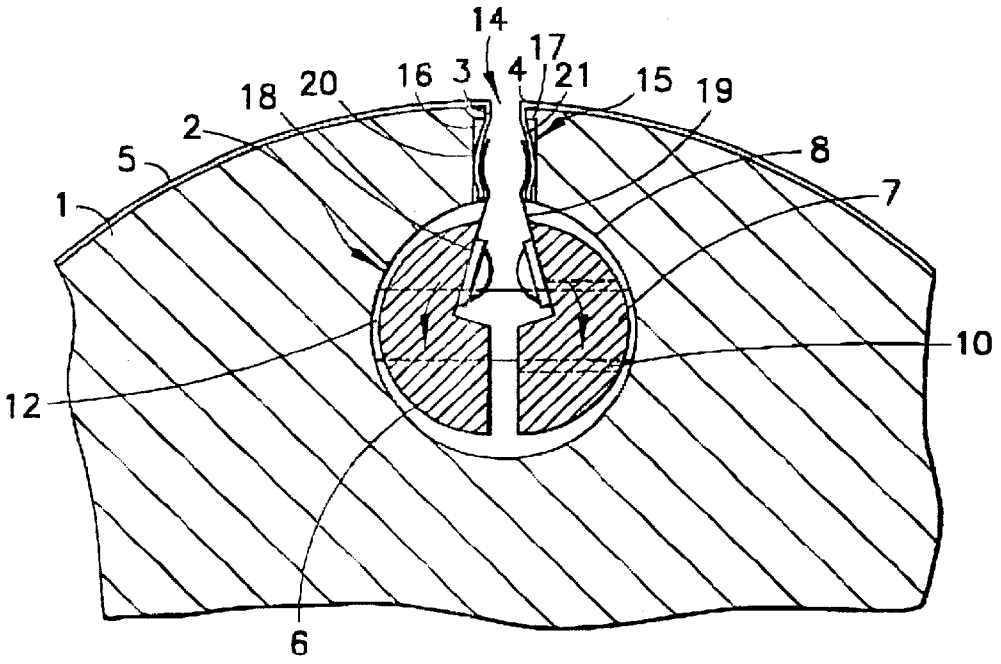
FIG. 1 shows a cross section of a device with a printing plate fastened on a plate cylinder according to the present invention.
Figure 5:
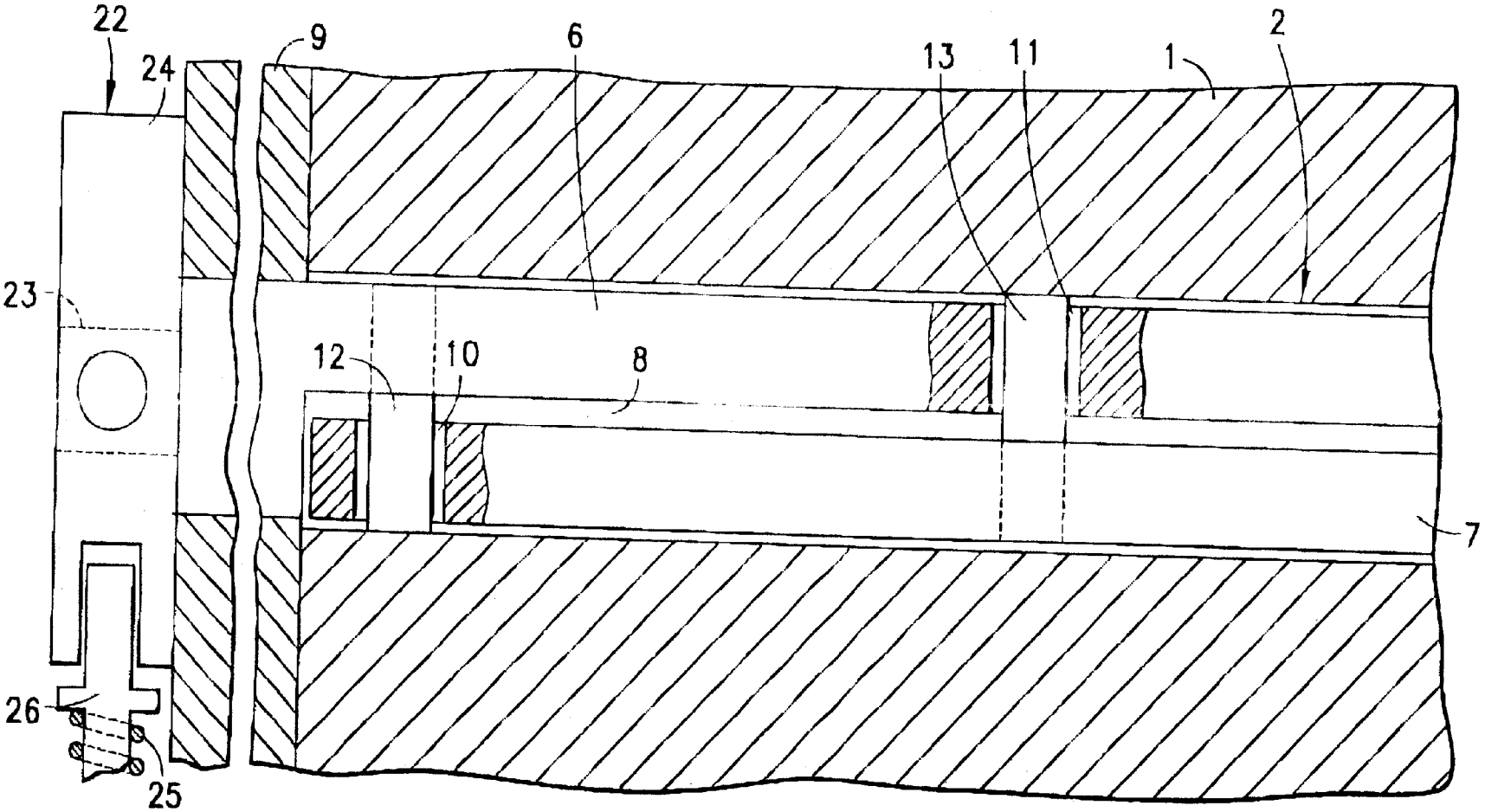
FIG. 5 is a longitudinal section of the device according to FIG. 1.

FIG. 1 shows a detail of a plate cylinder 1 having a channel 2 running in its longitudinal direction, in which the inserted ends 3, 4, bent approximately at a right angle of a flexible printing plate 5 are fastened. For this purpose, two segmented shafts 6, 7 are pivotally arranged in a bore 8 in the channel 2. The segmented shafts 6, 7 are in each case mounted laterally on one side in a region in the bore 8 which surrounds the other segmented shaft 7 or 6, in the plate cylinder 1 or in a Schmitz (bearer) ring 9 firmly connected to the plate cylinder 1. The shafts 6, 7 are supported against the wall of the bore 8 by means of at least one supporting element 12 or 13 which passes through the other segmented shaft 7 or 6 in a recess 10 or 11 with a clearance needed for the pivoting action (FIG. 5).

The channel 2 has a region 15 which connects the bore 8 to a channel gap 14 on the periphery of the plate cylinder 1 in the radial direction of the plate cylinder 1. The region is equipped with recesses 16, 17 at a predetermined radial distance from the periphery of the plate cylinder 1. The recesses 16, 17 extend as far as the bore (FIG. 1).

Leaf springs 18, 19 which reach into the region of the recesses are fastened to the segment shafts 6, 7 which are cut out for this purpose. At their ends, the leaf springs 18 19 engage in an appropriately fittingly deformed manner in shell like or curved shaped elements 20, 21, each projecting in the direction of the recesses 16, 17 and of the bent ends 3, 4 of the printing plate. When the leaf springs 18, 19 contact the bent ends 3, 4, the ends 3, 4, are urged into the recesses 16, 17, resulting in a combined positive and frictional connection in the channel 2.

Figure 2:
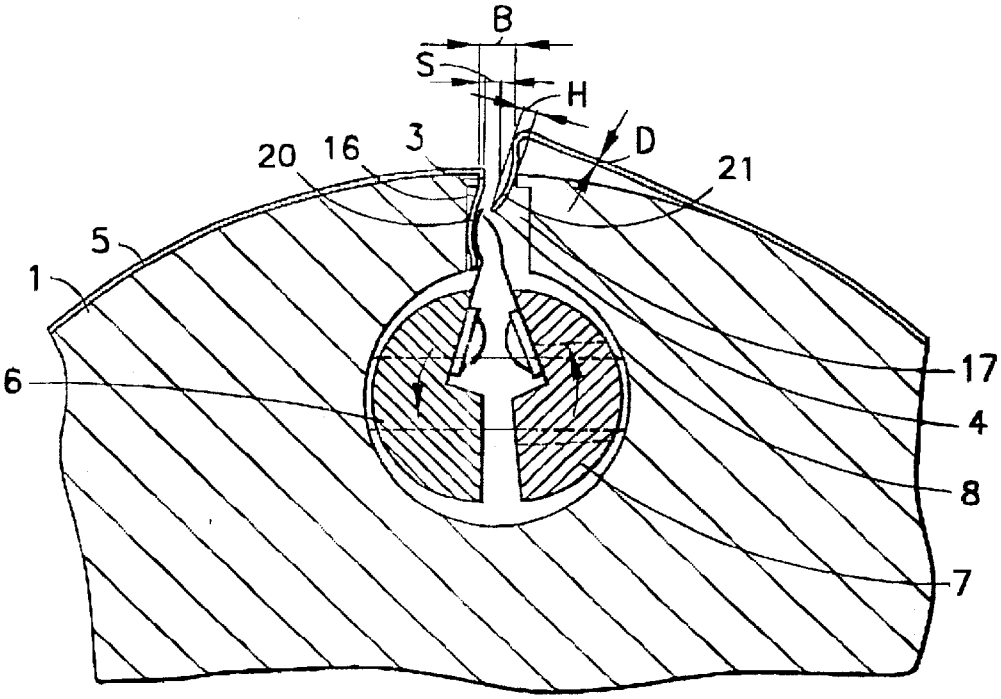
FIG. 2 shows the device according to FIG. 1 during insertion of a second bent end of the printing plate into a channel in the plate cylinder.

FIG. 2 shows insertion of the second bent end 4 of the printing plate 5 into the channel 2 or its withdrawal from the channel 2. For this purpose, the segmented shaft 7 is pivoted in the counter-clockwise direction, so that the second end 4 can be inserted into the channel 2, past the leaf springs 19 resting on the leaf springs 18 of the other segmented shaft 6.

Figure 3:
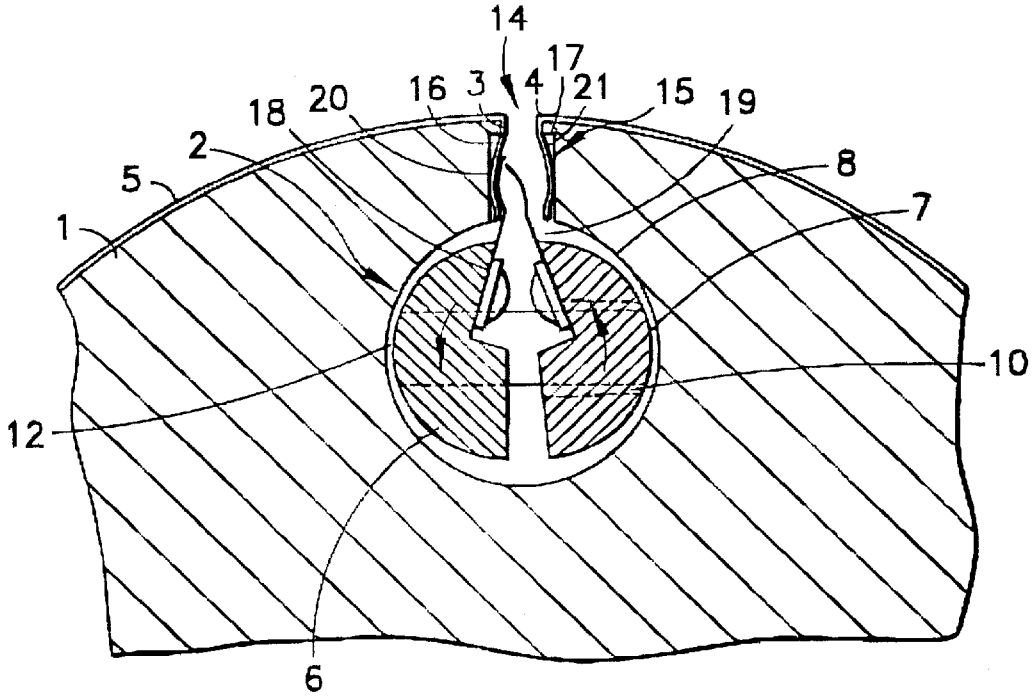
FIG. 3 shows a device according to FIG. 1 before clamping the inserted, second end of the printing plate in the channel.

FIG. 3 shows the second end 4 completely inserted into the channel 2 before its clamping in the recess 7 by the leaf springs 19 by means of pivoting the segmented shaft 7 in the clockwise direction. The foregoing descriptions relating to FIGS. 2 and 3 apply equally as well to both ends 3, 4 of the printing plate 5.

Figure 4:
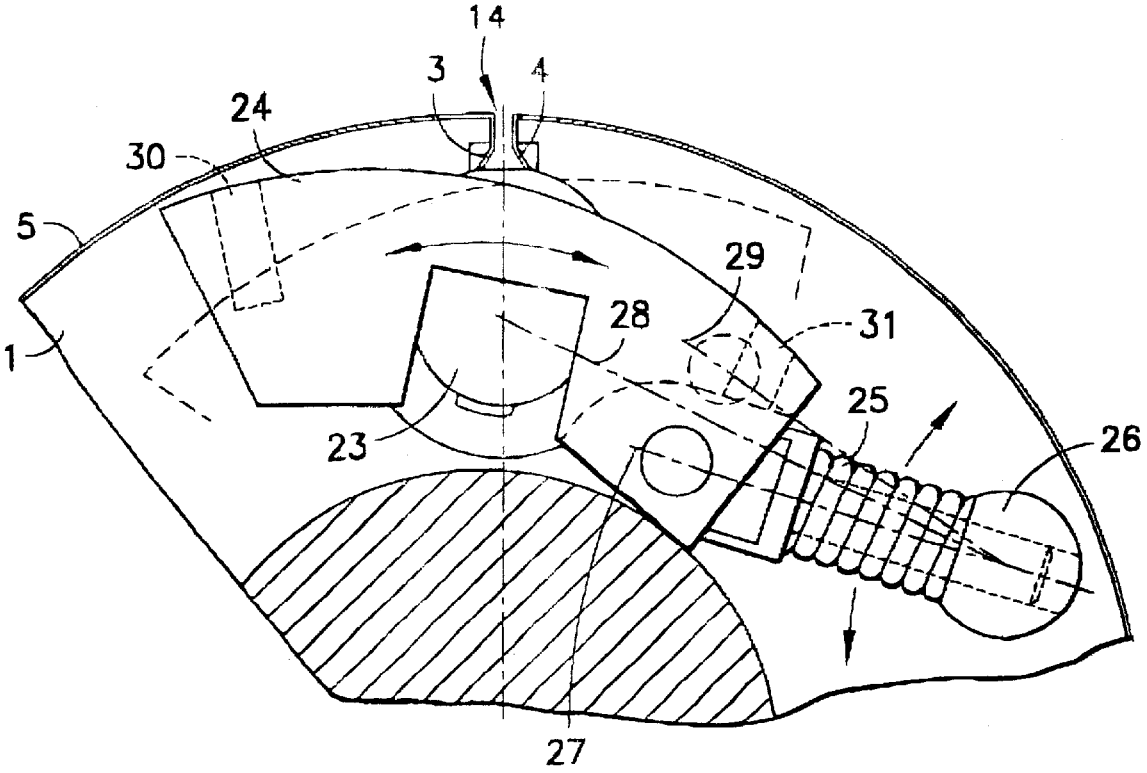
FIG. 4 is a movement mechanism for the device according to FIG. 1 showing a detail of a side view of the plate cylinder.

FIGS. 4 and 5 show a movement mechanism 22 for the segmented shaft 6 for illustration. The following description applies as well to the other segmented shaft 7. A lever 24 is fastened on a journal 23 of the segmented shaft 6 and is supported in the manner of a toggle lever, via a spring 25, against a pivoting support 26 mounted in the plate cylinder 1.

FIG. 4 shows the segmented shaft 6 in a position where the leaf springs 18 are pivoted away from the bent end 3 of the printing plate 5. In order to clamp the end 3, the lever 24 is pivoted from this position 27 over the dead or neutral position 28 characterized by a stretched position of the lever 24 and pivoting support 26, into the position 29 which is illustrated dashed. The segmented shafts 6, 7 are thus in each case automatically blocked or held in the positions 27; 29 by the toggle-lever effect. The lever 24 can be pivoted by means of an operating tool (not shown) which can be inserted alternately into corresponding holes 30; 31.

The channel gap 14 has a relatively narrow width B which, according to FIG. 2, has the thickness D that is essentially as thick as twice that of the printing plate 5. The height H of the channel gap 14 is essentially that of a shaped element 21 of a bent end 4 of the printing plate 5. The clearance S of the channel gap 14 is that which is needed for the insertion of the second end 4 into the channel 2, this clearance being minimized by the lateral recesses 16, 17.

Figure 6:
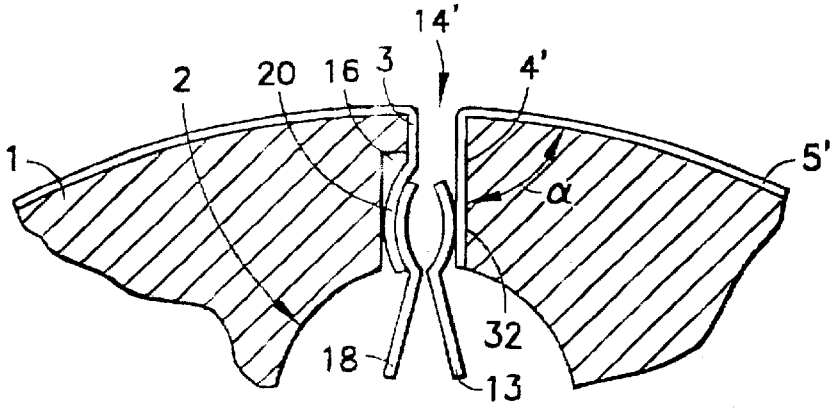
FIG. 6 is a cross sectional view of another embodiment of the present invention showing the trailing end of the printing plate.

FIG. 6 shows an alternative embodiment of the device according to the present invention. The means of fastening the trailing end 4 of the printing plate 5' in the channel 2 is changed with respect to FIG. 1. In order to accommodate the leading end 3, the channel gap 14' is provided with the recess 16 in this region. The trailing end 4' is bent virtually rectangularly at an angle $\alpha$, the angle $\alpha$ being less than or equal to 90°. The trailing end 4' can be inserted at a contact face 32 arranged in the channel gap 14'. This contact face 32, conforming to the trailing end 4', is also designed with the angle $\alpha$ so that after the end 4' has been inserted, it rests on the contact face 32. The leaf springs 18, 19 extend into the region of the recess 16 and onto the contact face 32. The leaf springs 18, 19, for example, may be of a shell like configuration and have the effect on the ends 3, 4' of the printing plate 5' of at least one of a positive and a frictional connection in the channel 2.

Figure 7:
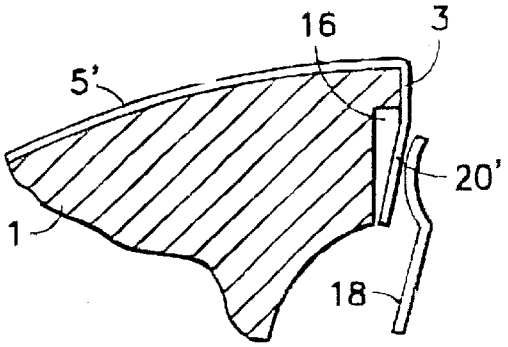
FIG. 7 shows an alternative embodiment of the present invention provided with a second bending edge, differing from FIG. 1 and FIG. 6.

FIG. 7 shows a further alternative embodiment of the present invention, in which the leading end 3 is inserted completely into the channel 2 before being clamped in the recess 16 by leaf springs 18. In this case, as opposed to the embodiment shown in FIG. 1 and FIG. 6, the leading end 3 is provided with a bent-over 20' functioning as a shaped element in the region of the recess 16.

Figure 8:
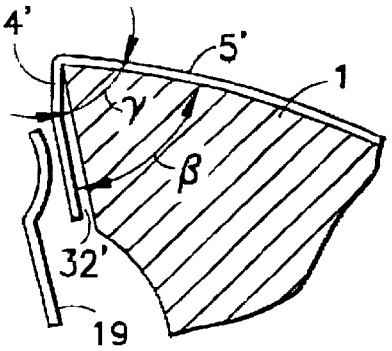
FIG. 8 shows an alternative embodiment of the present invention including a trailing end of a printing plate.

FIG. 8 shows the trailing end 4', which is bent over only once at the edge, in a manner similar to FIG. 6. In this case, the trailing end 4' is inserted completely into the channel 2 before being clamped on the contact face 32' by the leaf springs 19. The trailing end 4' is bent virtually rectangularly at an angle $\beta$, the angle $\beta$ being less than or equal to 90°. The contact face 32' is designed with an angle $\gamma$, whose magnitude is less than the angle $\beta$, so that after the end 4' has been inserted, it rests with play on the contact face 32'. The leaf spring 19 subsequently presses the end 4' against the contact face 32', so that this end 4' is clamped onto the contact face 32' by means of a frictional connection.

Figure 9:
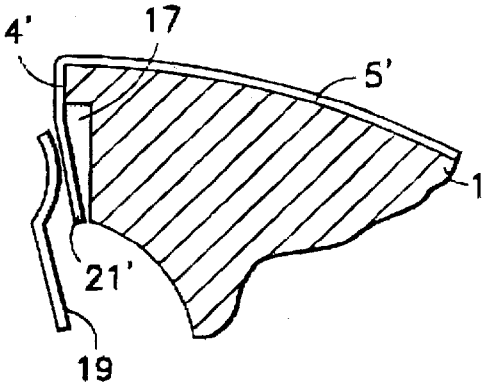
FIG. 9 shows a further view of the embodiment for fastening a trailing end of a printing plate according to FIG. 6.

FIG. 9 shows a further alternative embodiment of the present invention which differs from those shown in FIGS. 6 and 8 in that the trailing end 4' is provided with an additional bent over edge 21' functioning as a shaped element. The trailing end 4' is inserted completely into the channel 2 before a clamping occurs in the recess 17 (designed according to FIG. 1) by means of the leaf springs 19. The additional bent-over edge 21' is located in the region of the recess 17.

Figure 10:
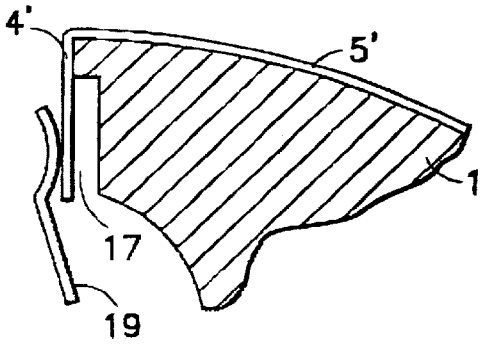
FIG. 10 shows an alternative embodiment for fastening a trailing end of a printing plate being provided with only one bent edge.

FIG. 10 is a variation of the embodiment of FIG. 9, the trailing end 4' not having a bent over edge in the region of the recess 17.

Thus, while there have shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. A device for fastening a flexible printing plate to a printing cylinder of a rotary printing machine, comprising:

a printing plate including a leading bent end and a trailing bent end, each end being bent at an approximately 90° angle with respect to the plate;

a printing cylinder having a channel with a channel gap, at least one lateral cut out, and a bore, the channel being formed axially parallel to the cylinder so that the channel gap is formed at a radial periphery of the channel, the bore being formed at a radial terminus of the channel, the at least one lateral cut out being in the channel a predetermined distance from the gap and from the bore at least at a leading edge side of the cylinder, with respect to a direction of rotation of the cylinder;

a segmented shaft pivotally arranged in the bore, the segmented shaft including a first shaft segment and a second shaft segment; and a plurality of leaf springs including a first leaf spring having a first engaging end and a second leaf spring having a second engaging end, each leaf spring being arranged in the channel, the first leaf spring being attached to the first shaft segment so as to render the first leaf spring capable of contacting the leading end of the printing plate at the first engaging end, the second leaf spring being attached to the second shaft segment so as to render the second leaf spring capable of contacting the trailing end of the printing plate at the second engaging end, when the respective ends of the printing plate are inserted into the channel, at least the leading end of the printing plate comprises a shaped element into which the first engaging end of the first leaf spring is engagable upon a pressure contact of the leading end of the printing plate with the first engaging end so as to bend the leading end of the printing plate into the cut out.

2. The device according to claim 1, wherein the printing cylinder further comprises a contact face in the channel opposed to the at least one lateral cut out, wherein the trailing end of the printing plate is capable of being moved into contact with the contact face and deformed upon a pressure contact with the second engaging end.

3. The device according to claim 2, wherein the contact face is at an angle ($\alpha$) with respect to the plate and corresponds to the angle of the trailing end.

4. The device according to claim 2, wherein the trailing end of the printing plate is bent at an angle ($\beta$) with respect to the plate, the contact face being sloped at an angle ($\gamma$), wherein ($\gamma$) is less than ($\beta$).

5. The device according to claim 1, wherein both the leading end and the trailing end of the printing plate have a shaped element that is shell shaped, such that a contour of each printing plate end conforms to a contour of a respective engaging end of the leaf spring.

6. The device according to claim 1, wherein the leading end comprises a bent over edge in a region of the at least one lateral cut out.

7. The device according to claim 1, further comprising another lateral cutout formed in the channel at a predetermined distance both from the gap and from the bore at a trailing edge side of the channel, wherein the trailing end comprises a bent over edge in a region of the cut out.

8. The device according to claim 1, wherein each segmented shaft has ends and at least one recess, the device further comprising:

at least one first support element for the first shaft segment arranged in a region of the bore surrounding the second shaft element and passing through the second shaft element via the recess, for mounting the first shaft segment coaxially opposed to the second shaft segment, the at least one recess being configured so as to allow a clearance for pivoting of the segmented shafts; and at least one second support element for the second shaft element arranged in a region of the bore surrounding the first shaft element and passing through the first shaft element via the recess, for mounting the second shaft segment coaxially opposed to the first shaft segment, the at least one recess being configured so as to allow a clearance for pivoting of the segmented shafts.

9. The device according to claim 1, further comprising:

a movement mechanism moveably arranged exterior to a side of the plate cylinder and connected to the segmented shaft so as to effect a pivoting motion of the segmented shaft.

10. The device according to claim 9, wherein the segmented shaft includes a journal arranged on the exterior of the side of the plate cylinder bearing the movement mechanism, the device further comprising:

a spring loaded lever fixedly attached to the journal and pivotally moveable into at least a first position, a central position, and a second position, the first position bringing the first leaf spring into contact with the leading end, the second position bringing the second leaf spring into contact with the trailing end, and the central position bringing both leaf springs into contact with their respective ends of the plate cylinder.

11. The device according to claim 1, wherein the channel gap has a width equal to approximately a thickness of the printing plate, a height of a shaped element, and a clearance sufficient to accommodate insertion of the trailing end of the printing plate into the cylinder.

* * * * *